United States Patent [19]

Walton

[11] 4,161,315

[45] Jul. 17, 1979

[54] STACKER FOR GAME COUNTERS

[76] Inventor: Jimmy W. Walton, 201 North St., Cascade, Wis. 53011

[21] Appl. No.: 850,960

[22] Filed: Nov. 14, 1977

[51] Int. Cl.[2] ..... A63F 3/00; A63F 9/00

[52] U.S. Cl. ..... 273/262; 273/290; 40/491

[58] Field of Search ..... 273/288, 289, 290, 255, 273/262, 260, 148 A, 148 R, 241; 40/10 D, 16, 16.4, 490, 491; 35/73, 31 D, 35 H

[56] References Cited

U.S. PATENT DOCUMENTS

| | | | |
|---|---|---|---|
| 1,997,501 | 4/1935 | Sweney | 273/157 R |
| 2,610,060 | 9/1952 | Powell | 273/262 X |
| 2,736,115 | 2/1956 | James | 40/312 |
| 3,524,645 | 8/1970 | Breslow | 273/148 A X |
| 3,552,702 | 1/1971 | Springer | 40/11 R X |
| 3,553,864 | 1/1971 | Karlyn et al. | 40/10 D |
| 3,594,923 | 7/1971 | Midgley | 35/73 X |
| 3,680,865 | 8/1972 | Davis | 273/290 X |
| 3,683,532 | 8/1972 | Ankrum | 40/120 X |
| 3,768,812 | 10/1973 | Basa | 273/246 |
| 3,917,272 | 11/1975 | Aldea | 273/290 X |
| 3,921,330 | 11/1975 | Drieze | 273/157 R X |

*Primary Examiner*—Richard C. Pinkham
*Assistant Examiner*—Scott L. Brown

[57] ABSTRACT

A stacker is described for facilitating the play of war games and the like. Such games are played on a game board and cardboard counters are typically used to represent personnel or military hardware. Frequently the counters are stacked on top of one another and need to be moved. To overcome the tendency of knocking over the stacked counters and also to facilitate the evaluation of the counters in the stack, a frame is provided for holding the counters in a vertical, side-to-side orientation. The frame may be moved and both sides of the counters may be displayed to the players if desired or required. In a first embodiment of the invention, the frame comprises a flat base designed to fit within the spaces of the game board and two aligned track members perpendicularly affixed to the base. The counters are held between the two tracks. In an alternate embodiment of the present invention, the track members are replaced by an elongate plastic strip which includes a fold forming clip for supporting the counters.

7 Claims, 4 Drawing Figures

STACKER FOR GAME COUNTERS

FIELD OF THE INVENTION

The invention relates generally to the art of toys and games and more particularly to a stacking device for counters used in the play of war games and the like.

BACKGROUND OF THE INVENTION

While war games have been played in a variety of forms for a number of years, the games have grown in popularity in the last few years. While war games are used in the specification for describing the present invention, it should be recognized that the stacker can be used in a variety of different games so it should be understood that the reference to any particular type of game or method of play is only for purposes of illustration.

In one common type of game, a playing board is provided which is divided into many individual spaces which together define the "territory" of the game. The board might depict a village, a country or even the whole world in some games. In addition, the board might include designated geographic areas such as hills, rivers, lakes and the like.

The players in the game are given various personnel and military headquarters which are represented by counters. The counters are typically square cardboard pieces which may be ½–⅝" on a side and about 1/16" thick. They carry on at least one of their faces either designs, numbers, or both, to tell the players what each counter represents. Following the rules for the particular game, the counters are placed on a game board and are moved about the board.

The players attempt to win the game by attacking opponents or taking the strategic positions on the board, and most popular games include a rule which permits a player to stack several counters on a single space to increase the player's odds in an attack on an opponent occupying an adjoining space. Following the attack, if the player is successful, the stack of counters is moved into the space formerly occupied by the opponent, or the stack may be split or withdrawn, as desired.

Two common problems exist with respect to the play of such games. The movement of the stack of counters is difficult, expecially if there are many pieces on adjacent spaces. In fact, a considerable amount of playing time of the games is consumed by moving such stacks. It should also be mentioned that in many of the games, the board may have several hundred pieces on it.

The second problem arises if the "value" of the stack must be determined prior to a move. It is quite common that several pieces of different values will be in the same stack and the analysis of the value of the stack requires that the pieces be lifted up individually. Again this procedure is time consuming and increases the chances of other pieces accidentally being dislodged from their proper location.

A device which makes the movement and evaluation of counter stacks easier would add to the enjoyment of such games and would represent a significant advance in this art.

OBJECTS OF THE INVENTION

It is a primary object of the present invention to provide a stacker for game counters which permits the disadvantages referred to above to be overcome.

Another object of the present invention is to provide a stacker for game counters which allows the counters to be easily moved from one space to another.

Yet another object of the present invention is to provide a stacker for game counters which also permits the value of the individual counters to be displayed to all of the game players.

How these and other objects of the present invention are accomplished will be described in the remainder of this specification taken in conjunction with the FIGURES. Generally, however, the objects are accomplished by providing a frame for supporting the counters of a stack in a vertical side to side arrangement so that the printed matter on the face of the counters is displayed to the players. The stacker includes a base adapted to fit within the spaces of the game board. In one embodiment of the invention, two parallel track members are attached to the base in a perpendicular oreientation, the track members including aligned grooves for receiving opposed sides of the counter squares. In another embodiment, a plastic, elongate clip members is perpendicularly affixed to the base to receive the individual counters. Other variations of the present invention which fall within its scope are also described in the remainder of the specification.

DESCRIPTION OF THE PREFERRED EMBODIMENT

Figure 1:
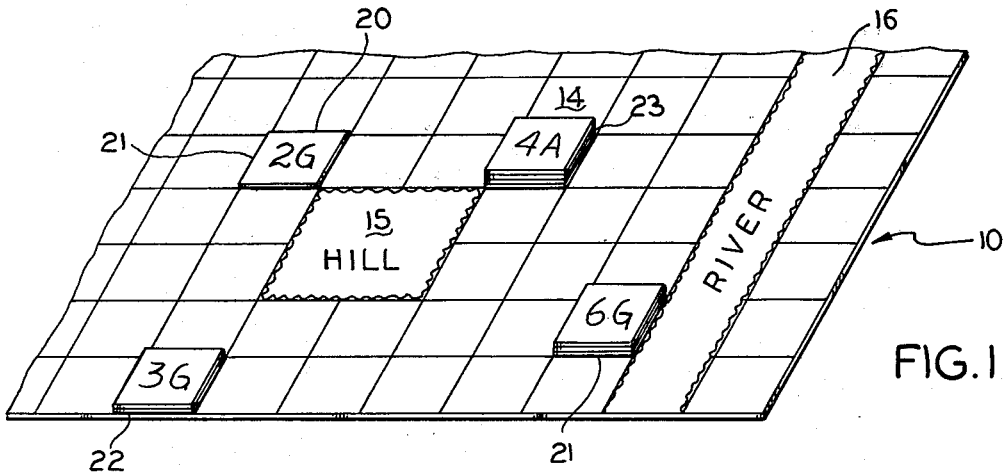
FIG. 1 is a perspective view of a portion of a typical game board showing counter stacks as typically encountered in war games.

FIG. 1 shows an illustrative form of game board 10 according to the prior art and it should be recognized that the printed matter on the board and on the counters (to be described shortly) is solely for purposes of illustration and the FIGURE is not meant to depict any known game or board layout.

Board 10 is divided by lines 12 into a plurality of equal size spaces 14. In many games certain of the spaces may define geographic objects or obstacles and in FIG. 1, a hill 15 and a river 16 are depicted on the section of board 10. These features may or may not be included, but commonly they add to the complexity and the interest of the game.

FIG. 1 also illustrates four positions occupied by counters 20 and each position has a different number of counters on it, i.e. square 21 includes one counter, square 22 includes two counters, square 23 includes three counters and square 24 includes four counters. It should also be noted in FIG. 1 that the face of each counter includes a number and a letter. This is merely to illustrate that the counters can have different values and characteristics. The letter "G" and "A" might represent, for example, guns or artillary in an army game, but it is only important to realize that the value of the stack cannot be determined solely by reference to the top counter.

Figure 2:
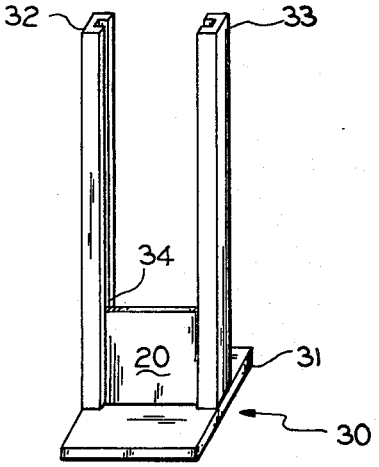
FIG. 2 is a perspective view of one preferred form of counter stacker according to the present invention.

In most commercially available games the counters 20 are made of square cardboard about 1/16" thick and about ½–⅝" on a side. As indicated above, the movement of a stack of such counters 20 and the lifting of individual pieces to determine stack value is quite cumbersome and time consuming. According to one form of the present invention illustrated in FIG. 2, such movement and determination is made easier by employing a stacker 30 for the game counters which includes a flat base 31 adapted to fit within the boundaries of the spaces on board 10 and two elongate members 31 and 33 mounted perpendicularly to base 31. The members 32 and 33 each include an elongate channel 34 which is open at the top of members 32 and 33 and which extends to the base 31. In one preferred embodiment, the space between the two channels is ½" or ⅝", obviously depending on the size of the particular game counters. It will be appreciated then that the counters 20 can be inserted between the channels (from the top) so that they are positioned within their square surfaces oriented perpendicularly to base 31. FIG. 2 illustrates how one such counter is located in stacker 30.

Stacker 30 may be prepared in a variety of ways, e.g. extrusion, moulding, or assembly and the scope of the present invention is meant to cover all such methods of preparation. In the assembly method, two equal length pieces of channel material 32 and 33 are merely affixed to the base 31 in the illustrated manner. Also, while it is not critical to the invention, stacker 30 may be prepared from plastic (which is preferred) wood, metal, rubber or various combinations of the foregoing. It should also be appreciated that a sufficient number of stackers 30 will be provided with a game or purchased for use in the game so that each participant will have enough for use at any time more than one counter occupies a playing space.

Figure 3:
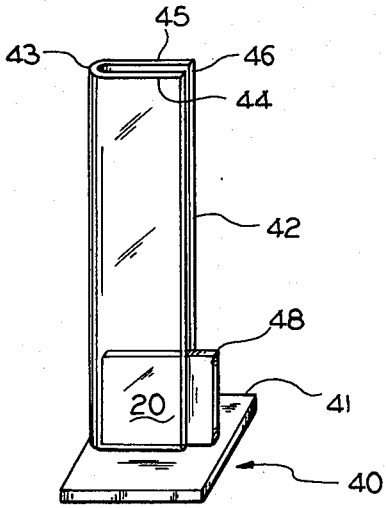
FIG. 3 is a perspective view of an alternate form of counter stacker according to the present invention.

An alternate embodiment of the present invention is shown in FIG. 3. In this embodiment the stacker 40 includes a base 41 which is similar to the base described for the first embodiment. However, in this embodiment the channel members 32 and 33 are replaced by a unitary elongate clip member 42. Clip 42 in the preferred form of this embodiment comprises a strip of plastic material which includes a fold 43 along its length to form front and back flaps 44 and 45 respectively. The edges of flaps 44 and 45 opposite the fold 43 form an open slit 46 which preferably is just slightly narrower than the thickness of the counters to be used. Each flap is also preferably narrower than the width of the counters as is shown in this FIGURE.

Stacker 40 is used by merely sliding a counter 20 between flaps 44 and 45 toward base 41. The edge 48 of a stacker can be easily grasped by the player to insert and guide the counter to the position shown in FIG. 3. While it may not be required for all types of games, it is preferred that the material used for clip 42 be transparent so that any graphic or numeric information contained on the counter will be clearly visible. As with the first described embodiment, the length of clip 42 is selected to accommodate at least several counters up to the limit of counters normally encountered on one space on the board under the applicable rules.

A wide variety of materials can be used for clip 42 and base 41, but again plastics are preferred. Plastic clips have the advantage of providing a spring-like tension on the counters but it will be apparent that metal, wood or rubber strips having a slit for insertion of the counters could also be used.

Figure 4:
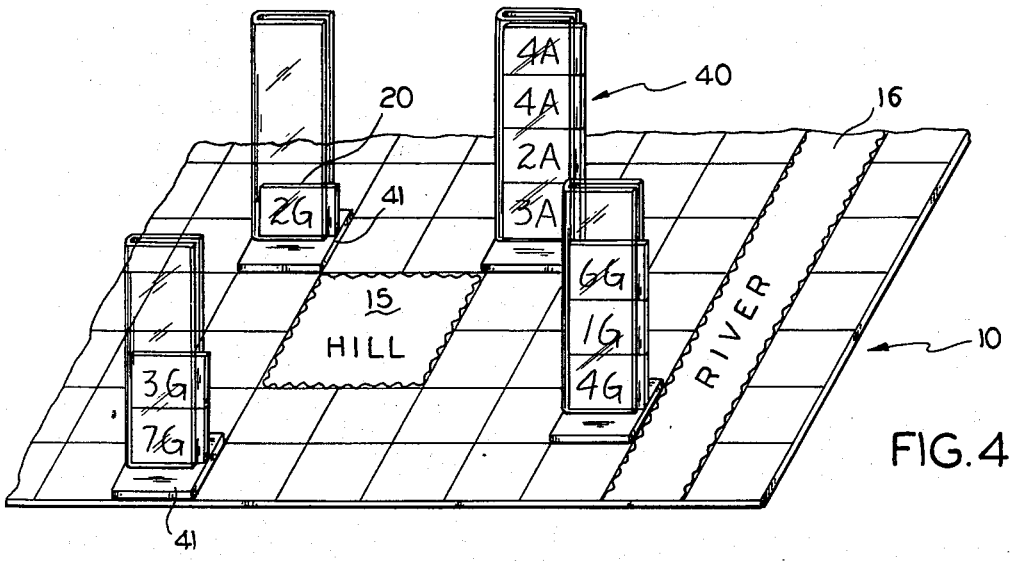
FIG. 4 is a perspective view, similar to FIG. 1, but showing the use of the counter stacker of FIG. 3 in a war game.

Referring now to FIG. 4, the same game board 10 shown in FIG. 1 is shown together with stackers 40 of the second illustrated form of the present invention. The stackers 40 have a capacity of four counters but the length should not be taken as limiting. It will be noted in the drawing that the stackers readily display each individual counter and its value.

While the present invention has been described in connection with two specific embodiments, it is not to be limited thereby because other stacker systems will be readily apparent after reading the foregoing description. For example, the stacker could include a vertical standard having pegs, hooks or a velcro covering and the particular counter could include holes or velcro so that the counters could readily be attached to the standard in the desired position. Alternately, clip 42 could be replaced by two separate vertical strips of clear plastic (i.e. eliminating the fold) in a face to face relationship having sufficient space therebetween to accommodate the counters. Therefore, the invention is to be limited solely by the claims which follow.

I claim:

1. A stacker for holding and displaying a plurality of game counters, said game counters comprising thin, generally square pieces, said stacker comprising:

a flat, generally square base having a size approximately equal to the size of said counters; and an elongate clip means perpendicularly mounted to said base for holding said plurality of counters in a position whereby said counters are oriented perpendicularly with respect to said base, said clip means comprising an elongate, generally rectangular piece of plastic material folded along its length to form two flaps, said flaps being joined along one side by said fold and being open at its other side to define an elongate slit, said slit being adapted for receiving said counters.

2. The invention set forth in claim 1 wherein said plastic is clear plastic material whereby said counters may be displayed through said flaps.

3. In combination:

a game board divided into a plurality of playing spaces;

playing pieces comprising thin, generally square pieces of material; and stackers for holding and displaying a plurality of said pieces comprising a flat base having a size selected to fit within a single one of said playing spaces and means perpendicularly mounted to said base for holding and displaying said plurality of pieces in a position whereby said pieces are oriented perpendicularly with respect to said base.

4. The invention set forth in claim 3 wherein said playing pieces include graphic information on at least one face thereof and said stacker is constructed of clear plastic material whereby said graphic material is visible when said pieces are held in said stackers.

5. The invention set forth in claim 3 wherein said perpendicular means comprises a pair of elongate track means mounted to said base parallel to each other, each of said track means including a channel running along its length and said channels being oriented toward one another whereby said counters may be slidably received between said track means.

6. The invention set forth in claim 3 wherein said perpendicular means comprises an elongate clip means.

7. The invention set forth in claim 6 wherein said clip means comprises an elongate, generally rectangular piece of plastic material folded along its length to form two flaps, said flaps being joined along one side by said fold and being open at its other side to define an elongate slit, said slit being adapted for receiving said counters.

* * * * *